US012098438B2

(12) United States Patent
Kamo et al.

(10) Patent No.: US 12,098,438 B2
(45) **Date of Patent: *Sep. 24, 2024**

(54) STAINLESS STEEL SEAMLESS PIPE

(71) Applicant: JFE STEEL CORPORATION, Tokyo (JP)

(72) Inventors: Yuichi Kamo, Tokyo (JP); Masao Yuga, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 470 days.

This patent is subject to a terminal disclaimer.

(21) Appl. No.: 17/599,219

(22) PCT Filed: Feb. 28, 2020

(86) PCT No.: PCT/JP2020/008403

§ 371 (c)(1),
(2) Date: Sep. 28, 2021

(87) PCT Pub. No.: WO2020/202957

PCT Pub. Date: Oct. 8, 2020

(65) Prior Publication Data

US 2022/0177990 A1 Jun. 9, 2022

(30) Foreign Application Priority Data

Mar. 29, 2019 (JP) ..... 2019-065259

(51) Int. Cl.

| | |
|---|---|
| ***C21D 9/08*** | (2006.01) |
| ***C21D 6/00*** | (2006.01) |
| ***C21D 8/10*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/42*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |
| ***C22C 38/52*** | (2006.01) |
| ***C22C 38/54*** | (2006.01) |

(52) U.S. Cl.

CPC ..... *C21D 9/085* (2013.01); *C21D 6/004* (2013.01); *C21D 6/005* (2013.01); *C21D 6/007* (2013.01); *C21D 6/008* (2013.01); *C21D 8/105* (2013.01); *C22C 38/001* (2013.01); *C22C 38/002* (2013.01); *C22C 38/005* (2013.01); *C22C 38/008* (2013.01); *C22C 38/02* (2013.01); *C22C 38/04* (2013.01); *C22C 38/06* (2013.01); *C22C 38/42* (2013.01); *C22C 38/44* (2013.01); *C22C 38/46* (2013.01); *C22C 38/48* (2013.01); *C22C 38/50* (2013.01); *C22C 38/52* (2013.01); *C22C 38/54* (2013.01); *C21D 2211/001* (2013.01); *C21D 2211/005* (2013.01); *C21D 2211/008* (2013.01)

(58) Field of Classification Search

None

See application file for complete search history.

(56) References Cited

U.S. PATENT DOCUMENTS

| | | | | |
|---|---|---|---|---|
| 5,778,714 | A | 7/1998 | Katsumura et al. | |
| 10,151,011 | B2 | 12/2018 | Eguchi et al. | |
| 11,306,369 | B2 * | 4/2022 | Kamo | C21D 1/22 |
| 2015/0152531 | A1 * | 6/2015 | Eguchi | C21D 6/004 148/592 |
| 2015/0315684 | A1 * | 11/2015 | Eguchi | C21D 6/004 148/506 |
| 2022/0364211 | A1 * | 11/2022 | Kamo | C21D 9/08 |
| 2023/0048685 | A1 * | 2/2023 | Kamo | C22C 38/04 |
| 2023/0090789 | A1 * | 3/2023 | Sasaki | C22C 38/50 148/590 |
| 2023/0128437 | A1 * | 4/2023 | Eguchi | C22C 38/04 148/592 |

(Continued)

FOREIGN PATENT DOCUMENTS

| | | |
|---|---|---|
| CN | 106282845 A | 1/2017 |
| EP | 3 456 852 A1 | 3/2019 |

(Continued)

OTHER PUBLICATIONS

Jun. 2, 2020 International Search Report issued in International Patent Application No. PCT/JP2020/008403.

Jan. 18, 2022 Extended European Search Report issued in European Patent Application No. 20 78 1945.9.

Aug. 23, 2022 Office Action issued in U.S. Appl. No. 16/476,970.

(Continued)

*Primary Examiner* — Brian D Walck

(74) *Attorney, Agent, or Firm* — Oliff PLC

(57) ABSTRACT

A stainless steel seamless pipe having high strength, excellent low-temperature toughness and corrosion resistance, and a composition including, in mass %, C: 0.06% or less, Si: 1.0% or less, Mn: 0.01% or more and 1.0% or less, P: 0.05% or less, S: 0.005% or less, Cr: 14.0% or more and 17.0% or less, Mo: more than 3.80% and 6.0% or less, Cu: more than 1.03% and 3.5% or less, Ni: 3.5% or more and 6.0% or less, Al: 0.10% or less, N: 0.10% or less, O: 0.010% or less, and the balance is Fe and incidental impurities. Elements C, Si, Mn, Cr, Ni, Mo, Cu, and N satisfy a predetermined relationship. The stainless steel seamless pipe has a yield strength of 862 MPa or more and has a microstructure that contains at least 40% martensitic phase, at most 60% ferrite phase, and at most 30% retained austenite phase by volume.

8 Claims, No Drawings

(56) References Cited

U.S. PATENT DOCUMENTS

2023/0137295 A1* 5/2023 Kamo ..... C22C 38/42
148/592

FOREIGN PATENT DOCUMENTS

| | | | |
|---|---|---|---|
| EP | 3 569 724 | A1 | 11/2019 |
| JP | 2001-140040 | A | 5/2001 |
| JP | 2014-25145 | A | 2/2014 |
| JP | 2015-110822 | A | 6/2015 |
| JP | 2016-117944 | A | 6/2016 |
| JP | 2017-510715 | A | 4/2017 |
| JP | 6399259 | B1 | 10/2018 |
| WO | 2010/134498 | A1 | 11/2010 |
| WO | 2014/097628 | A1 | 6/2014 |
| WO | 2014/112353 | A1 | 7/2014 |
| WO | 2017/138050 | A1 | 8/2017 |
| WO | 2018/020886 | A1 | 2/2018 |
| WO | 2018/131340 | A1 | 7/2018 |
| WO | 2019/035329 | A1 | 2/2019 |

OTHER PUBLICATIONS

Apr. 13, 2021 Office Action issued in U.S. Appl. No. 16/487,203.
Aug. 2, 2021 Office Action issued in U.S. Appl. No. 16/487,203.
Boljanovic, Vukota. "Metail Shaping Pocesses: Casting and Molding; Particulate Processing; Deformation Processes; and Metal Removal". pp. 13-15, 2010.

* cited by examiner

STAINLESS STEEL SEAMLESS PIPE

TECHNICAL FIELD

The present application relates to a martensitic stainless steel seamless pipe suited for oil country tubular goods for oil wells and gas wells (hereinafter, referred to simply as "oil wells"). Particularly, the disclosed embodiments relate to improvement of corrosion resistance in various corrosive environments such as a severe high-temperature corrosive environment containing carbon dioxide ($CO_2$) and chlorine ions ($Cl^-$), and a hydrogen sulfide ($H_2S$)-containing environment, and to improvement of low-temperature toughness.

BACKGROUND

An expected shortage of energy resources in the near future has prompted active development of oil country tubular goods for use in applications that were unthinkable in the past, for example, such as in deep oil fields, a carbon dioxide gas-containing environment, and a hydrogen sulfide-containing environment, or a sour environment as it is also called. The steel pipes for oil country tubular goods intended for these environments require high strength and excellent corrosion resistance.

Oil country tubular goods used for mining of oil fields and gas fields in environments containing $CO_2$, $Cl^-$, and the like typically use 13Cr martensitic stainless steel pipes. There has also been development of oil country tubular goods capable of withstanding higher temperatures (a temperature as high as 200° C.). However, the corrosion resistance of 13Cr martensitic stainless steel is not always sufficient for such applications. Accordingly, there is a need for a steel pipe for oil country tubular goods that shows excellent corrosion resistance even when used in such environments.

In connection with such a demand, for example, PTL 1 describes a high-strength stainless steel seamless pipe for oil country tubular goods having a composition comprising, in mass %, C: 0.05% or less, Si: 0.5% or less, Mn: 0.15 to 1.0%, P: 0.030% or less, S: 0.005% or less, Cr: 13.5 to 15.4%, Ni: 3.5 to 6.0%, Mo: 1.5 to 5.0%, Cu: 3.5% or less, W: 2.5% or less, N: 0.15% or less, and in which C, Si, Mn, Cr, Ni, Mo, W, Cu, and N satisfy a specific relationship. It is stated in this related art that a high-strength stainless steel seamless pipe for oil country tubular goods can be manufactured that has strength with a yield strength of 110 ksi (758 MPa) or more, and that shows sufficient corrosion resistance even in a severe high-temperature corrosive environment containing $CO_2$, $Cl^-$, and $H_2S$.

PTL 2 describes a high-strength stainless steel seamless pipe for oil country tubular goods having excellent corrosion resistance. The high-strength stainless steel seamless pipe has a composition comprising, in mass %, C: 0.05% or less, Si: 0.5% or less, Mn: 0.15 to 1.0%, P: 0.030% or less, S: 0.005% or less, Cr: 15.5 to 17.5%, Ni: 3.0 to 6.0%, Mo: 1.5 to 5.0%, Cu: 4.0% or less, W: 0.1 to 2.5%, and N: 0.15% or less, and in which C, Si, Mn, Cr, Ni, Mo, Cu, N, and W satisfy a specific relationship. It is stated in this related art that a high-strength stainless steel seamless pipe for oil country tubular goods can be manufactured that has strength with a yield strength of 110 ksi (758 MPa) or more, and that shows sufficient corrosion resistance even in a severe high-temperature corrosive environment containing $CO_2$, $Cl^-$, and $H_2S$.

PTL 3 describes a stainless steel seamless pipe for oil country tubular goods having a composition comprising, in mass %, C: 0.05% or less, Si: 0.50% or less, Mn: 0.20 to 1.80%, P: 0.030% or less, S: 0.005% or less, Cr: 14.0 to 18.0%, Ni: 5.0 to 8.0%, Mo: 1.5 to 3.5%, Cu: 0.5 to 3.5%, Al: 0.10% or less, Nb: more than 0.20% and 0.50% or less, V: 0.20% or less, N: 0.15% or less, and O: 0.010% or less, and in which Cr, Ni, Mo, Cu, C, Si, Mn, and N satisfy a specific relationship. It is stated in this related art that a stainless steel seamless pipe for oil country tubular goods can be manufactured that has strength with a yield strength of 110 ksi (758 MPa) or more, and that shows sufficient corrosion resistance even in a severe high-temperature corrosive environment containing $CO_2$, $Cl^-$, and $H_2S$.

PTL 4 describes a high-strength stainless steel seamless pipe for oil country tubular goods having a composition comprising, in mass %, C: 0.05% or less, Si: 1.0% or less, Mn: 0.1 to 0.5%, P: 0.05% or less, S: less than 0.005%, Cr: more than 15.0% and 19.0% or less, Mo: more than 2.0% and 3.0% or less, Cu: 0.3 to 3.5%, Ni: 3.0% or more and less than 5.0%, W: 0.1 to 3.0%, Nb: 0.07 to 0.5%, v: 0.01 to 0.5%, Al: 0.001 to 0.1%, N: 0.010 to 0.100%, and O: 0.01% or less, and in which Nb, Ta, C, N, and Cu satisfy a specific relationship, and having a microstructure that contains at least 45% tempering martensitic phase, 20 to 40% ferrite phase, and more than 10% and at most 25% retained austenite phase by volume. It is stated in this related art that a high-strength stainless steel seamless pipe for oil country tubular goods can be manufactured that has strength with a yield strength YS of 862 MPa or more, and that shows sufficient corrosion resistance even in a severe high-temperature corrosive environment containing $CO_2$, $Cl^-$, and $H_2S$.

PTL 5 describes a high-strength stainless steel seamless pipe for oil country tubular goods having a composition comprising, in mass %, C: 0.05% or less, Si: 0.5% or less, Mn: 0.15 to 1.0%, P: 0.030% or less, S: 0.005% or less, Cr: 14.5 to 17.5%, Ni: 3.0 to 6.0%, Mo: 2.7 to 5.0%, Cu: 0.3 to 4.0%, W: 0.1 to 2.5%, V: 0.02 to 0.20%, Al: 0.10% or less, and N: 0.15% or less, and in which C, Si, Mn, Cr, Ni, Mo, Cu, N, and W satisfy a specific relationship, and having a microstructure that contains more than 45% martensitic phase (a dominant phase), 10 to 45% ferrite phase (a secondary phase), and at most 30% retained austenite phase by volume. It is stated in this related art that a high-strength stainless steel seamless pipe for oil country tubular goods can be manufactured that has strength with a yield strength YS of 862 MPa or more, and that shows sufficient corrosion resistance even in a severe high-temperature corrosive environment containing $CO_2$, $Cl^-$, and $H_2S$.

PTL 6 describes a high-strength stainless steel seamless pipe for oil country tubular goods having a composition comprising, in mass %, C: 0.05% or less, Si: 0.5% or less, Mn: 0.15 to 1.0%, P: 0.030% or less, S: 0.005% or less, Cr: 14.5 to 17.5%, Ni: 3.0 to 6.0%, Mo: 2.7 to 5.0%, Cu: 0.3 to 4.0%, W: 0.1 to 2.5%, V: 0.02 to 0.20%, Al: 0.10% or less, N: 0.15% or less, and B: 0.0005 to 0.0100%, and in which C, Si, Mn, Cr, Ni, Mo, Cu, N, and W satisfy a specific relationship, and having a microstructure that contains more than 45% martensitic phase (a dominant phase), 10 to 45% ferrite phase (a secondary phase), and at most 30% retained austenite phase by volume. It is stated in this related art that a high-strength stainless steel seamless pipe for oil country tubular goods can be manufactured that has strength with a yield strength, YS, of 862 MPa or more, and that shows sufficient corrosion resistance even in a severe high-temperature corrosive environment containing $CO_2$, $Cl^-$, and $H_2S$.

CITATION LIST

Patent Literature

PTL 1: JP-A-2014-25145
PTL 2: JP-A-2015-110822
PTL 3: WO2014/112353
PTL 4: WO2017/138050
PTL 5: WO2018/020886
PTL 6: Japanese Patent No. 6399259

SUMMARY

Technical Problem

Desirable low-temperature toughness is required in cold climate applications. In the field of oil country tubular goods material, it is common practice to evaluate low-temperature toughness by absorption energy at −10° C. in a Charpy impact test, $vE_{-10}$, and the test requires an absorption energy of at least 300 J. The steels disclosed in the foregoing PTL 1 to PTL 6 contain a ferrite phase. The characteristic of the fracture mode of ferrite phase is that the ferrite phase, which is ductile at high temperatures, abruptly becomes brittle once it reaches a certain temperature. Such a temperature is commonly known as ductile-brittle transition temperature (hereinafter, also referred to as "transition temperature"). When a Charpy impact test is conducted at a test temperature in the vicinity of the transition temperature, the Charpy absorption energy tends to show variation, and, if absorption energy is solely taken as an index of low-temperature toughness evaluation, the test might yield the false result that the steel, when tested with limited numbers of specimens, has desirable low-temperature toughness. An evaluation conducted at a single test temperature also involves safety concerns in terms of toughness in a lower-temperature environment. For this reason, low-temperature toughness is often evaluated from the perspective of transition temperature, in addition to the absorption energy, and a transition temperature of −40° C. or less is needed as the required performance.

It is stated in the foregoing PTL 1 to PTL 6 that the techniques described in these related art documents can produce a steel pipe that passes an SSC test conducted by dipping a test specimen in a test solution: a 20 mass % NaCl aqueous solution (liquid temperature of 25° C.; atmosphere of $H_2S$ of 0.1 atm and $CO_2$ of 0.9 atm) kept in an autoclave and having an adjusted pH of 3.5 with addition of acetic acid and sodium acetate, and applying a stress equal to 90% of the yield stress for 720 hours in the solution. However, it cannot be said that these techniques are satisfactory in terms of achieving high strength with a yield strength, YS, of 862 MPa or more while providing excellent low-temperature toughness, in addition to ensuring sulfide stress cracking resistance (SSC resistance) in an even more severe environment. The following discusses possible explanations for this by the present inventors.

Sulfide stress cracking of stainless steel is caused by generation of large amounts of hydrogen as a result of an increased corrosion rate due to the pitting corrosion at defective portions of a passive film. In order to obtain desirable SSC resistance, it is effective to add elements that improve pitting corrosion resistance, for example, such as Cr, Mo, and W. However, Cr, Mo, and W are elements that stabilize the ferrite phase, and, when added in large amounts, accelerate grain growth in the ferrite phase when heat is applied to make a steel pipe from a raw steel pipe material. This seriously impairs the low-temperature toughness of the final product. When added in large amounts, Mo and W precipitate into intermetallic compounds during the tempering process, and decrease the low-temperature toughness. For the same purpose, PTL 5 discloses a technique that makes the total amount of Cr, Mo, and W 0.75% or less by mass in the precipitate. However, it is still difficult with the technique disclosed in PTL 5 to achieve desirable low-temperature toughness while ensuring desirable SSC resistance.

As described above, the techniques of the related art are not satisfactory in terms of providing a stainless steel seamless pipe having high strength and desirable low-temperature toughness while ensuring desirable sulfide stress cracking resistance (SSC resistance), desirable carbon dioxide corrosion resistance, and desirable sulfide stress corrosion cracking resistance (SCC resistance).

The disclosed embodiments are intended to provide a solution to the problems of the related art, and it is an object of the disclosed embodiments to provide a stainless steel seamless pipe having high strength with a yield strength of 862 MPa (125 ksi) or more, and excellent low-temperature toughness with an absorption energy at −10° C., $VE_{-10}$, of 300 J or more, and a ductile-brittle transition temperature of −40° C. or less as measured by a Charpy impact test, in addition to having excellent corrosion resistance.

As used herein, "excellent corrosion resistance" means "excellent carbon dioxide corrosion resistance", "excellent sulfide stress corrosion cracking resistance (SCC resistance)", and "excellent sulfide stress cracking resistance (SSC resistance)".

As used herein, "excellent carbon dioxide corrosion resistance" means that a test specimen dipped in a test solution that is a 20 mass % NaCl aqueous solution (liquid temperature of 200° C.; a $CO_2$ gas atmosphere of 30 atm) in an autoclave has a corrosion rate of 0.127 mm/y or less after 336 hours in the solution.

As used herein, "excellent sulfide stress corrosion cracking resistance (SCC resistance)" means that a test specimen dipped in a test solution that is a 20 mass % NaCl aqueous solution (liquid temperature: 100° C.; an atmosphere of 30-atm $CO_2$ gas and 0.1-atm $H_2S$) kept in an autoclave and having an adjusted pH of 3.3 with addition of acetic acid and sodium acetate does not crack even after 720 hours under an applied stress equal to 100% of the yield stress in the solution.

As used herein, "excellent sulfide stress cracking resistance (SSC resistance)" means that a test specimen dipped in a test solution that is a 20 mass % NaCl aqueous solution (liquid temperature: 25° C.; an atmosphere of 0.9-atm $CO_2$ gas and 0.1-atm $H_2S$) kept in an autoclave and having an adjusted pH of 3.0 with addition of acetic acid and sodium acetate does not crack even after 720 hours under an applied stress equal to 90% of the yield stress in the solution.

As used herein, "yield strength" means a yield strength measured in compliance with the API (American Petroleum Institute) specifications for an API arc-shaped tensile test specimen taken from a heat-treated test material in such an orientation that the test specimen had a tensile direction along the pipe axis direction.

As used herein, "excellent low-temperature toughness" means having an absorption energy vE-10 at −10° C. of 300 J or more, and a ductile-brittle transition temperature of −40° C. or less as measured at a test temperature of 50° C. to −120° C. in a Charpy impact test conducted in compliance with the JIS 22242 specifications for a V-notch test specimen (10-mm thick) taken from a heat-treated test material in such an orientation that the test specimen had a longitudinal direction along the pipe axis direction.

Solution to Problem

In order to achieve the foregoing objects, the present inventors conducted intensive investigations of various factors that affect the corrosion resistance and low-temperature toughness of a stainless steel seamless pipe of a Cr-containing composition with a Cr content of 14.0 mass % or more. The stainless steel seamless pipe was found to show desired SSC resistance when it had a Mo content of more than 3.80 mass % and a Cu content of more than 1.03 mass %. The stainless steel seamless pipe was also found to show desired low-temperature toughness when it did not contain W, or contained W in a limited amount of 0.84% or less. The following discusses possible explanations for these findings by the present inventors.

Mo is an element that improves pitting corrosion resistance, and can improve the SSC resistance when contained in increased amounts. Cu reduces entry of hydrogen into steel by strengthening the protective coating, and can also improve the SSC resistance. W is thought to more easily precipitate into an intermetallic compound during tempering than Mo and Cu. This is probably the reason for the desired SSC resistance and low-temperature toughness obtained when the Mo content is more than 3.80 mass % and the Cu content is more than 1.03 mass %, and when W is not contained or is contained in a limited amount of 0.84% or less.

The disclosed embodiments are based on these findings, and were completed after further studies. Specifically, the disclosed embodiments are as follows.

[1] A stainless steel seamless pipe having a composition comprising, in mass&, C: 0.06% or less, Si: 1.0% or less, Mn: 0.01% or more and 1.0% or less, P: 0.05% or less, S: 0.005% or less, Cr: 14.0% or more and 17.0% or less, Mo: more than 3.80% and 6.0% or less, Cu: more than 1.03% and 3.5% or less, Ni: 3.5% or more and 6.0% or less, Al: 0.10% or less, N: 0.10% or less, and O: 0.010% or less, in which C, Si, Mn, Cr, Ni, Mo, Cu, and N satisfy the following formula (1), and the balance is Fe and incidental impurities, the stainless steel seamless pipe having a microstructure that contains at least 40% martensitic phase, at most 60% ferrite phase, and at most 30% retained austenite phase by volume, the stainless steel seamless pipe having a yield strength of 862 MPa or more, $$13.0 \leq -5.9 \times (7.82 + 27C - 0.91Si + 0.21Mn - 0.9Cr + Ni - 1.1Mo + 0.2Cu + 11N) \leq 50.0, \quad \text{Formula (1)}$$

wherein C, Si, Mn, Cr, Ni, Mo, Cu, and N represent the content of each element in mass %.

[2] The stainless steel seamless pipe according to [1], wherein the composition further comprises, in mass %, W: 0.84% or less.

[3] The stainless steel seamless pipe according to [1] or [2], wherein the composition further comprises, in mass %, one or two or more selected from Nb: 0.5% or less, V: 0.5% or less, and B: 0.01% or less.

[4] The stainless steel seamless pipe according to any one of [1] to [3], wherein the composition further comprises, in mass %, one or two or more selected from Ti: 0.3% or less, Zr: 0.3% or less, Co: 1.5% or less, and Ta: 0.3% or less.

[5] The stainless steel seamless pipe according to any one of [1] to [4], wherein the composition further comprises, in mass %, one or two or more selected from Ca: 0.01% or less, REM: 0.3% or less, Mg: 0.01% or less, Sn: 0.2% or less, and Sb: 1.0% or less.

Advantageous Effects

The disclosed embodiments have enabled production of a stainless steel seamless pipe having high strength with a yield strength of 862 MPa (125 ksi) or more, and excellent low-temperature toughness with an absorption energy at −10° C., $VE_{-10}$, of 300 J or more, and a ductile-brittle transition temperature of −40° C. or less as measured by a Charpy impact test, in addition to having excellent corrosion resistance, including excellent carbon dioxide corrosion resistance even in a $CO_2$− and $Cl^-$-containing severe high-temperature corrosive environment of 200° C., and excellent sulfide stress corrosion cracking resistance and excellent sulfide stress cracking resistance.

DESCRIPTION OF EMBODIMENTS

A stainless steel seamless pipe of the disclosed embodiments is a stainless steel seamless pipe having a composition comprising, in mass %, C: 0.06% or less, Si: 1.0% or less, Mn: 0.01% or more and 1.0% or less, P: 0.05% or less, S: 0.005% or less, Cr: 14.0% or more and 17.0% or less, Mo: more than 3.80% and 6.0% or less, Cu: more than 1.03% and 3.5% or less, Ni: 3.5% or more and 6.0% or less, Al: 0.10% or less, N: 0.10% or less, and 0: 0.010% or less, and in which C, Si, Mn, Cr, Ni, Mo, Cu, and N satisfy the following formula (1), and the balance is Fe and incidental impurities, the stainless steel seamless pipe having a microstructure that contains at least 40% martensitic phase, at most 60% ferrite phase, and at most 30% retained austenite phase by volume, the stainless steel seamless pipe having a yield strength of 862 MPa or more.

$$13.0 \leq -5.9 \times (7.82 + 27C - 0.91Si + 0.21Mn - 0.9Cr + Ni - 1.1Mo + 0.2Cu + 11N) \leq 50.0, \quad \text{Formula (1)}$$

wherein C, Si, Mn, Cr, Ni, Mo, Cu, and N represent the content of each element in mass %, and the content is 0 (zero) for elements that are not contained.

The following describes the reasons for specifying the composition of a seamless steel pipe of the disclosed embodiments. In the following, "%" means percent by mass, unless otherwise specifically stated.

C: 0.06% or Less

C is an element that becomes incidentally included in the process of steelmaking. Corrosion resistance decreases when C is contained in an amount of more than 0.06%. For this reason, the C content is 0.06% or less. The C content is preferably 0.05% or less, more preferably 0.04% or less. Considering the decarburization cost, the lower limit of C content is preferably 0.002%, more preferably 0.003% or more.

Si: 1.0% or Less

Si is an element that acts as a deoxidizing agent. However, hot workability and corrosion resistance decrease when Si is contained in an amount of more than 1.08. For this reason, the Si content is 1.0% or less. The Si content is preferably 0.7% or less, more preferably 0.5% or less. It is not particularly required to set a lower limit, as long as the deoxidizing effect is obtained. However, in order to obtain a sufficient deoxidizing effect, the Si content is preferably 0.03% or more, more preferably 0.05% or more.

Mn: 0.01% or More and 1.0% or Less

Mn is an element that acts as a deoxidizing agent and a desulfurizing agent, and improves hot workability. Mn also increases the steel strength. Mn is contained in an amount of 0.01% or more to obtain these effects. Toughness decreases when the Mn content is more than 1.0%. For this reason, the Mn content is 0.01% or more and 1.0% or less. The Mn content is preferably 0.03% or more, more preferably 0.05% or more. The Mn content is preferably 0.8% or less, more preferably 0.6% or less.

P: 0.05% or Less

P is an element that impairs the corrosion resistance, including carbon dioxide corrosion resistance, and sulfide stress cracking resistance. P is therefore contained preferably in as small an amount as possible in the disclosed embodiments. However, a P content of 0.05% or less is acceptable. For this reason, the P content is 0.05% or less. The P content is preferably 0.04% or less, more preferably 0.03% or less.

S: 0.005% or Less

S is an element that seriously impairs hot workability, and interferes with stable operations of hot working in the pipe manufacturing process. S exists as sulfide inclusions in steel, and impairs the corrosion resistance. S should therefore be contained preferably in as small an amount as possible. However, a S content of 0.005% or less is acceptable. For this reason, the S content is 0.005% or less. The S content is preferably 0.004% or less, more preferably 0.003% or less.

Cr: 14.0% or More and 17.0% or Less

Cr is an element that forms a protective coating on steel pipe surface, and contributes to improving the corrosion resistance. The desired corrosion resistance cannot be ensured when the Cr content is less than 14.0%. For this reason, Cr needs to be contained in an amount of 14.0% or more. When contained in an amount of more than 17.0%, the ferrite fraction becomes overly high, and the desired strength cannot be ensured. For this reason, the Cr content is 14.0% or more and 17.0% or less. The Cr content is preferably 14.2% or more, more preferably 14.5% or more. The Cr content is preferably 16.3% or less, more preferably 16.0% or less.

Mo: More than 3.80% and 6.0% or Less

By stabilizing the protective coating on steel pipe surface, Mo increases the resistance against pitting corrosion due to $Cl^-$ and low pH, and improves the sulfide stress cracking resistance and sulfide stress corrosion cracking resistance. This makes Mo an important element in the disclosed embodiments. Mo needs to be contained in an amount of more than 3.80% to obtain the desired corrosion resistance. A Mo content of more than 6.0% leads to decrease of low-temperature toughness. For this reason, the Mo content is more than 3.80% and 6.0% or less. The Mo content is preferably 3.85% or more, more preferably 3.90% or more. The Mo content is preferably 5.8% or less, more preferably 5.5% or less.

Cu: More than 1.03% and 3.5% or Less

Cu increases the retained austenite, and contributes to improving the yield strength by forming a precipitate. This makes it possible to obtain high strength without decreasing low-temperature toughness. Cu also acts to reduce entry of hydrogen into steel by strengthening the protective coating on steel pipe surface, and improve the sulfide stress cracking resistance and sulfide stress corrosion cracking resistance. Cu needs to be contained in an amount of more than 1.03% to obtain the desired strength and corrosion resistance. An excessively high Cu content results in decrease of hot workability in steel, and the Cu content is 3.5% or less. For this reason, the Cu content is more than 1.03% and 3.5% or less. The Cu content is preferably 1.2% or more, more preferably 1.5% or more. The Cu content is preferably 3.2% or less, more preferably 3.0% or less.

Ni: 3.5% or More and 6.0% or Less

Ni is an element that strengthens the protective coating on steel pipe surface, and contributes to improving the corrosion resistance. By solid solution strengthening, Ni also increases the steel strength, and improves the toughness of steel. These effects become more pronounced when Ni is contained in an amount of 3.5% or more. A Ni content of more than 6.0% results in decrease of martensitic phase stability, and decreases the strength. For this reason, the Ni content is 3.5% or more and 6.0% or less. The Ni content is preferably 4.0% or more, more preferably 4.5% or more. The Ni content is preferably 5.8% or less, more preferably 5.5% or less.

Al: 0.10% or Less

Al is an element that acts as a deoxidizing agent. However, low-temperature toughness decreases when Al is contained in an amount of more than 0.10%. For this reason, the Al content is 0.10% or less. The Al content is preferably 0.07% or less, more preferably 0.05% or less. It is not particularly required to set a lower limit, as long as the deoxidizing effect is obtained. However, in order to obtain a sufficient deoxidizing effect, the Al content is preferably 0.005% or more, more preferably 0.01% or more.

N: 0.10% or Less

N is an element that becomes incidentally included in the process of steelmaking. Ni is also an element that increases the steel strength. However, when contained in an amount of more than 0.10%, N forms nitrides, and decreases the toughness. For this reason, the N content is 0.10% or less. The N content is preferably 0.08% or less, more preferably 0.07% or less. The N content does not have a specific lower limit. However, an excessively low N content leads to increased steel manufacturing cost. For this reason, the N content is preferably 0.002% or more, more preferably 0.003% or more.

O: 0.010% or Less

O (oxygen) exists as an oxide in steel, and causes adverse effects on various properties. For this reason, O is contained preferably in as small an amount as possible in the disclosed embodiments. An O content of more than 0.010% results in decrease of hot workability, corrosion resistance, and toughness. For this reason, the 0 content is 0.010% or less.

In the disclosed embodiments, C, Si, Mn, Cr, Ni, Mo, Cu, and N are contained so as to satisfy the following formula (1), in addition to satisfying the foregoing composition.

$$13.0 \leq -5.9 \times (7.82 + 27C - 0.91Si + 0.21Mn - 0.9Cr + Ni - 1.1Mo + 0.2Cu + 11N) \leq 50.0, \quad \text{Formula (1)}$$

In the formula, C, Si, Mn, Cr, Ni, Mo, Cu, and N represent the content of each element in mass %.

In formula (1), the expression $-5.9 \times (7.82 + 27C - 0.91Si + 0.21Mn - 0.9Cr + Ni - 1.1Mo + 0.2Cu + 11N)$ (hereinafter, referred to also as "middle polynomial of formula (1)", or, simply, "middle value") is determined as an index that indicates the likelihood of ferrite phase formation. With the alloy elements of formula (1) contained in adjusted amounts so as to satisfy formula (1), it is possible to stably produce a composite microstructure of martensitic phase and ferrite phase, or a composite microstructure of martensitic phase, ferrite phase, and retained austenite phase. When any of the alloy elements occurring in formula (1) is not contained, the value of the middle polynomial of formula (1) is calculated by regarding the content of such an element as zero percent.

When the value of the middle polynomial of formula (1) is less than 13.0, the ferrite phase decreases, and defects and cracking become more likely to occur during hot working. On the other hand, when the value of the middle polynomial of formula (1) is more than 50.0, the ferrite phase becomes more than 60% by volume, and the desired strength cannot be ensured.

For this reason, the formula (1) specified in the disclosed embodiments sets a left-hand value of 13.0 as the lower limit, and a right-hand value of 50.0 as the upper limit.

In the disclosed embodiments, the balance in the composition above is Fe and incidental impurities.

In the disclosed embodiments, in addition to the foregoing basic components, the composition may further contain one or two or more optional elements (W, Nb, V, B, Ti, Zr, Co, Ta, Ca, REM, Mg, Sn, Sb), as follows.

Specifically, in the disclosed embodiments, the composition may additionally contain W: 0.84% or less.

In the disclosed embodiments, the composition may additionally contain one or two or more selected from Nb: 0.5% or less, V: 0.5% or less, and B: 0.01% or less.

In the disclosed embodiments, the composition may additionally contain one or two or more selected from Ti: 0.3% or less, Zr: 0.3% or less, Co: 1.5% or less, and Ta: 0.3% or less.

In the disclosed embodiments, the composition may additionally contain one or two or more selected from Ca: 0.01% or less, REM: 0.3% or less, Mg: 0.01% or less, Sn: 0.2% or less, and Sb: 1.0% or less.

W: 0.84% or Less

W is an element that contributes to improving steel strength, and that can increase the sulfide stress cracking resistance and sulfide stress corrosion cracking resistance by stabilizing the protective coating on steel pipe surface. Particularly, W improves the sulfide stress cracking resistance when contained with Mo. When contained in excessively high amounts, W precipitates into an intermetallic compound, and impairs low-temperature toughness. For this reason, W, when contained, is contained in an amount of 0.84% or less. The W content is preferably 0.001% or more, more preferably 0.005% or more. The W content is preferably 0.7% or less, more preferably 0.6% or less.

Nb: 0.5% or Less

Nb is an element that increases the strength, and may be added as required. A Nb content of more than 0.5% leads to decrease of toughness and sulfide stress cracking resistance. For this reason, Nb, when contained, is contained in an amount of 0.5% or less. The Nb content is preferably 0.4% or less, more preferably 0.3% or less. The Nb content is preferably 0.02% or more, more preferably 0.05% or more.

V: 0.5% or Less

V is an element that increases the strength, and may be added as required. A V content of more than 0.5% leads to decrease of toughness and sulfide stress cracking resistance. For this reason, V, when contained, is contained in an amount of 0.5% or less. The V content is preferably 0.4% or less, more preferably 0.3% or less. The V content is preferably 0.02% or more, more preferably 0.05% or more.

B: 0.01% or Less

Bis an element that increases the strength, and may be added as required. B also contributes to improving hot workability, and has the effect to reduce fracture and cracking during the pipe making process. On the other hand, a B content of more than 0.01% produces hardly any hot workability improving effect, and results in decrease of low-temperature toughness. For this reason, B, when contained, is contained in an amount of 0.01% or less. The B content is preferably 0.008% or less, more preferably 0.007% or less. The B content is preferably 0.0005% or more, more preferably 0.001% or more.

Ti: 0.3% or Less

Ti is an element that increases the strength, and may be added as required. In addition to this effect, Ti also has the effect to improve the sulfide stress cracking resistance. In order to obtain these effects, Ti is contained in an amount of preferably 0.0005% or more. A Ti content of more than 0.3% decreases toughness. For this reason, Ti, when contained, is contained in a limited amount of 0.3% or less.

Zr: 0.3% or Less

Zr is an element that increases the strength, and may be added as required. In addition to this effect, Zr also has the effect to improve the sulfide stress cracking resistance. In order to obtain these effects, Zr is contained in an amount of preferably 0.0005% or more. A Zr content of more than 0.3% decreases toughness. For this reason, Zr, when contained, is contained in a limited amount of 0.3% or less.

Co: 1.5% or Less

Co is an element that increases the strength, and may be added as required. In addition to this effect, Co also has the effect to improve the sulfide stress cracking resistance. In order to obtain these effects, Co is contained in an amount of preferably 0.0005% or more. A Co content of more than 1.5% decreases toughness. For this reason, Co, when contained, is contained in a limited amount of 1.5% or less.

Ta: 0.3% or Less

Ta is an element that increases the strength, and may be added as required. In addition to this effect, Ta also has the effect to improve the sulfide stress cracking resistance. In order to obtain these effects, Ta is contained in an amount of preferably 0.0005% or more. A Ta content of more than 0.3% decreases toughness. For this reason, Ta, when contained, is contained in a limited amount of 0.3% or less.

Ca: 0.01% or Less

Ca is an element that contributes to improving the sulfide stress corrosion cracking resistance by controlling the form of sulfide, and may be added as required. In order to obtain this effect, Ca is contained in an amount of preferably 0.0005% or more. When Ca is contained in an amount of more than 0.01%, the effect becomes saturated, and Ca cannot produce the effect expected from the increased content. For this reason, Ca, when contained, is contained in a limited amount of 0.01% or less.

REM: 0.3% or Less

REM is an element that contributes to improving the sulfide stress corrosion cracking resistance by controlling the form of sulfide, and may be added as required. In order to obtain this effect, REM is contained in an amount of preferably 0.0005% or more. When REM is contained in an amount of more than 0.3%, the effect becomes saturated, and REM cannot produce the effect expected from the increased content. For this reason, REM, when contained, is contained in a limited amount of 0.3% or less.

As used herein, "REM" means scandium (Sc; atomic number 21) and yttrium (Y; atomic number 39), as well as lanthanoids from lanthanum (La; atomic number 57) to lutetium (Lu; atomic number 71). As used herein, "REM concentration" means the total content of one or two or more elements selected from the foregoing REM elements.

Mg: 0.01% or Less

Mg is an element that improves the corrosion resistance, and may be added as required. In order to obtain this effect, Mg is contained in an amount of preferably 0.0005% or more. When Mg is contained in an amount of more than 0.01%, the effect becomes saturated, and Mg cannot produce the effect expected from the increased content. For this reason, Mg, when contained, is contained in a limited amount of 0.01% or less.

Sn: 0.2% or Less

Sn is an element that improves the corrosion resistance, and may be added as required. In order to obtain this effect, Sn is contained in an amount of preferably 0.001% or more. When Sn is contained in an amount of more than 0.2%, the effect becomes saturated, and Sn cannot produce the effect expected from the increased content. For this reason, Sn, when contained, is contained in a limited amount of 0.2% or less.

Sb: 1.0% or Less

Sb is an element that improves the corrosion resistance, and may be added as required. In order to obtain this effect, Sb is contained in an amount of preferably 0.001% or more. When Sb is contained in an amount of more than 1.0%, the effect becomes saturated, and Sb cannot produce the effect expected from the increased content. For this reason, Sb, when contained, is contained in a limited amount of 1.0% or less.

The following describes the reason for limiting the microstructure in the seamless steel pipe of the disclosed embodiments.

In addition to having the foregoing composition, the seamless steel pipe of the disclosed embodiments has a microstructure that contains at least 40% martensitic phase, at most 60% ferrite phase, and at most 30% retained austenite phase by volume.

In order to ensure the desired strength, the seamless steel pipe of the disclosed embodiments contains at least 40% martensitic phase by volume. In the disclosed embodiments, the ferrite is at most 60% by volume. With the ferrite phase, progression of sulfide stress corrosion cracking and sulfide stress cracking can be reduced, and excellent corrosion resistance is obtained. If the ferrite phase precipitates in a large amount of more than 60% by volume, it might not be possible to ensure the desired strength. The ferrite phase is preferably 5% or more by volume. The ferrite phase is preferably 50% or less by volume.

The seamless steel pipe of the disclosed embodiments contains at most 30% austenitic phase (retained austenite phase) by volume, in addition to the martensitic phase and the ferrite phase. Ductility and toughness improve by the presence of the retained austenite phase. If the austenitic phase precipitates in a large amount of more than 30% by volume, it is not possible to ensure the desired strength. For this reason, the retained austenite phase is 30% or less by volume. The retained austenite phase is preferably 5% or more by volume. The retained austenite phase is preferably 25% or less by volume.

For the measurement of the microstructure of the seamless steel pipe of the disclosed embodiments, a test specimen for microstructure observation is corroded with a Vilella's solution (a mixed reagent containing 2 g of picric acid, 10 ml of hydrochloric acid, and 100 ml of ethanol), and the structure is imaged with a scanning electron microscope (1,000 times magnification). The fraction of the ferrite phase microstructure (volume ratio (%)) is then calculated with an image analyzer.

Separately, an X-ray diffraction test specimen is ground and polished to have a measurement cross section (C cross section) orthogonal to the axial direction of pipe, and the fraction of the retained austenite (γ) phase microstructure (volume ratio (%)) is measured by an X-ray diffraction method. The fraction of the retained austenite phase microstructure is determined by measuring X-ray diffraction integral intensity for the (220) plane of the austenite phase (γ), and the (211) plane of the ferrite phase (α), and converting the calculated values using the following formula.

$$\gamma(\text{volume ratio})=100/(1+(I\alpha R\gamma/I\gamma R\alpha)),$$

wherein Iα is the integral intensity of α, Rα is the crystallographic theoretical value for α, Iγ is the integral intensity of γ, and Rγ is the crystallographic theoretical value for γ.

The fraction of the martensitic phase is the remainder other than the fractions of the ferrite phase and retained y phase determined by the foregoing measurement method. As used herein, "martensitic phase" may contain at most 5% precipitate phase by volume, other than the martensitic phase, the ferrite phase, and the retained austenite phase.

The following describes a preferred method for manufacturing a stainless steel seamless pipe of the disclosed embodiments.

Preferably, a molten steel of the foregoing composition is made into steel using a smelting process such as by using a converter, and formed into a steel pipe material, for example, a billet, using an ordinary method such as continuous casting, or ingot casting-billeting. The steel pipe material is then hot worked into a pipe using a known pipe manufacturing process, for example, the Mannesmann-plug mill process or the Mannesmann-mandrel mill process, to produce a seamless steel pipe of desired dimensions having the foregoing composition. The hot working may be followed by cooling. The cooling process is not particularly limited. After the hot working, the pipe is cooled to room temperature at a cooling rate about the same as air cooling, provided that the composition falls in the range of the disclosed embodiments.

In the disclosed embodiments, this is followed by a heat treatment that includes quenching and tempering.

In quenching, the steel pipe is reheated to a temperature of 850 to 1, 150° C., and cooled at a cooling rate of air cooling or faster. The cooling stop temperature is 50° C. or less in terms of a surface temperature. When the heating temperature is less than 850° C., a reverse transformation from martensite to austenite does not occur, and the austenite does not transform into martensite during cooling, with the result that the desired strength cannot be ensured. On the other hand, the crystal grains coarsen when the heating temperature exceeds 1,150° C. For this reason, the heating temperature of quenching is 850 to 1,150° C. The heating temperature of quenching is preferably 900° C. or more. The heating temperature of quenching is preferably 1,100° C. or less.

When the cooling stop temperature is more than 50° C., the austenite does not sufficiently transform into martensite, and the fraction of retained austenite becomes overly high. For this reason, the cooling stop temperature of the cooling in quenching is 50° C. or less in the disclosed embodiments.

Here, "cooling rate of air cooling or faster" means 0.01° C./s or more.

In quenching, the soaking time is preferably 5 to 30 minutes, in order to achieve a uniform temperature along a wall thickness direction, and prevent variation in the material.

In tempering, the quenched seamless steel pipe is heated to a tempering temperature of 500 to 650° C. The heating may be followed by natural cooling. A tempering temperature of less than 500° C. is too low to produce the desired tempering effect as intended. When the tempering temperature is higher than 650° C., precipitation of intermetallic compounds occurs, and it is not possible to obtain desirable low-temperature toughness. For this reason, the tempering temperature is 500 to 650° C. The tempering temperature is preferably 520° C. or more. The tempering temperature is preferably 630° C. or less.

In tempering, the holding time is preferably 5 to 90 minutes, in order to achieve a uniform temperature along a wall thickness direction, and prevent variation in the material.

After the heat treatment (quenching and tempering), the seamless steel pipe has a microstructure in which the martensitic phase, the ferrite phase, and the retained austenite phase are contained in a specific predetermined volume ratio. In this way, the stainless steel seamless pipe can have the desired strength and toughness, and excellent corrosion resistance.

The stainless steel seamless pipe obtained in the disclosed embodiments in the manner described above is a high-strength steel pipe having a yield strength of 862 MPa or more, and excellent low-temperature toughness and excellent corrosion resistance. Preferably, the yield strength is 1,034 MPa or less. The stainless steel seamless pipe of the disclosed embodiments can be used as a stainless steel seamless pipe for oil country tubular goods (a high-strength stainless steel seamless pipe for oil country tubular goods).

EXAMPLES

The disclosed embodiments are further described below through Examples.

Molten steels of the compositions shown in Tables 1-1 and 1-2 were made into steel using a converter, and cast into billets (steel pipe material) by continuous casting. The steel pipe material was heated, hot worked into a pipe with a model seamless rolling mill, and cooled by air cooling to produce a seamless steel pipe measuring 83.8 mm in outer diameter and 12.7 mm in wall thickness. The heating of the steel pipe material before hot working was carried out at a heating temperature of 1,250° C.

Each seamless steel pipe was cut into a test specimen material, which was then subjected to quenching that included reheating to a temperature of 960° C., and cooling (water cooling) the test specimen to a cooling stop temperature of 30° C. with 20 minutes of retention in soaking. This was followed by tempering that included heating to a temperature of 575° C., and air cooling the test specimen with 20 minutes of retention in soaking. In quenching, the water cooling was carried out at a cooling rate of 11° C./s. The air cooling (natural cooling) in tempering was carried out at a cooling rate of 0.04° C./s.

The steel was evaluated as being "Satisfied" when it satisfied formula (1), and "Unsatisfied" when it did not satisfy formula (1), as shown in Tables 1-1 and 1-2.

TABLE 1-1

| Steel | Composition (mass %) | | | | | | | | | | | | | Formula (1) (*3) | | |
|---|---|---|---|---|---|---|---|---|---|---|---|---|---|---|---|---|
| No. | C | Si | Mn | P | S | Cr | Mo | Cu | Ni | Al | N | O | Other | Value (*4) | Evaluation | Remarks |
| A | 0.0114 | 0.21 | 0.278 | 0.014 | 0.0008 | 14.61 | 4.21 | 2.09 | 4.53 | 0.021 | 0.020 | 0.0032 | — | 27.3 | Satisfied | Present steel |
| B | 0.0120 | 0.20 | 0.306 | 0.015 | 0.0010 | 14.66 | 4.23 | 1.36 | 5.40 | 0.019 | 0.023 | 0.0027 | — | 23.0 | Satisfied | Present steel |
| C | 0.0177 | 0.22 | 0.281 | 0.016 | 0.0010 | 15.34 | 4.09 | 3.43 | 5.41 | 0.019 | 0.019 | 0.0030 | — | 22.6 | Satisfied | Present steel |
| D | 0.0550 | 0.22 | 0.305 | 0.014 | 0.0010 | 14.80 | 4.39 | 3.41 | 5.00 | 0.019 | 0.026 | 0.0032 | — | 17.8 | Satisfied | Present steel |
| E | 0.0082 | 0.95 | 0.327 | 0.015 | 0.0009 | 16.24 | 4.56 | 2.58 | 4.52 | 0.019 | 0.034 | 0.0030 | — | 41.2 | Satisfied | Present steel |
| F | 0.0133 | 0.22 | 0.950 | 0.014 | 0.0011 | 14.49 | 4.22 | 2.53 | 4.86 | 0.019 | 0.035 | 0.0032 | — | 22.1 | Satisfied | Present steel |
| G | 0.0175 | 0.20 | 0.015 | 0.014 | 0.0012 | 14.97 | 4.43 | 1.79 | 4.54 | 0.019 | 0.017 | 0.0030 | — | 30.4 | Satisfied | Present steel |
| H | 0.0099 | 0.20 | 0.281 | 0.045 | 0.0010 | 15.11 | 4.46 | 1.89 | 5.35 | 0.021 | 0.026 | 0.0032 | — | 26.7 | Satisfied | Present steel |
| I | 0.0117 | 0.20 | 0.294 | 0.015 | 0.0045 | 15.08 | 4.50 | 2.59 | 4.57 | 0.020 | 0.023 | 0.0032 | — | 30.5 | Satisfied | Present steel |
| J | 0.0146 | 0.22 | 0.287 | 0.016 | 0.0009 | 16.25 | 4.08 | 3.35 | 4.75 | 0.022 | 0.016 | 0.0028 | — | 32.1 | Satisfied | Present steel |
| K | 0.0165 | 0.21 | 0.278 | 0.016 | 0.0009 | 14.10 | 4.19 | 2.83 | 5.05 | 0.020 | 0.025 | 0.0027 | — | 19.4 | Satisfied | Present steel |
| L | 0.0111 | 0.20 | 0.324 | 0.014 | 0.0011 | 16.07 | 5.90 | 3.06 | 5.13 | 0.021 | 0.027 | 0.0028 | — | 40.7 | Satisfied | Present steel |
| M | 0.0084 | 0.22 | 0.273 | 0.016 | 0.0008 | 15.69 | 3.90 | 2.31 | 5.04 | 0.021 | 0.035 | 0.0032 | — | 27.2 | Satisfied | Present steel |
| N | 0.0160 | 0.19 | 0.275 | 0.014 | 0.0010 | 14.65 | 4.54 | 3.40 | 4.60 | 0.020 | 0.028 | 0.0029 | — | 26.4 | Satisfied | Present steel |
| O | 0.0091 | 0.19 | 0.302 | 0.015 | 0.0010 | 15.52 | 4.60 | 1.10 | 4.93 | 0.021 | 0.019 | 0.0032 | — | 33.7 | Satisfied | Present steel |
| P | 0.0175 | 0.22 | 0.301 | 0.014 | 0.0012 | 16.07 | 4.35 | 2.33 | 5.90 | 0.021 | 0.019 | 0.0029 | — | 26.7 | Satisfied | Present steel |

TABLE 1-1-continued

| Steel No. | Composition (mass %) C | Si | Mn | P | S | Cr | Mo | Cu | Ni | Al | N | O | Other | Formula (1) (*3) Value (*4) | Evaluation | Remarks |
|---|---|---|---|---|---|---|---|---|---|---|---|---|---|---|---|---|
| Q | 0.0157 | 0.19 | 0.280 | 0.015 | 0.0010 | 14.59 | 4.41 | 2.14 | 4.08 | 0.018 | 0.029 | 0.0032 | — | 29.7 | Satisfied | Present steel |
| R | 0.0182 | 0.21 | 0.326 | 0.014 | 0.0009 | 14.71 | 4.31 | 1.74 | 4.63 | 0.095 | 0.022 | 0.0030 | — | 27.0 | Satisfied | Present steel |
| S | 0.0112 | 0.32 | 0.293 | 0.016 | 0.0009 | 14.94 | 4.13 | 2.56 | 5.36 | 0.021 | 0.095 | 0.0030 | — | 18.8 | Satisfied | Present steel |
| T | 0.0192 | 0.20 | 0.278 | 0.016 | 0.0008 | 15.57 | 4.26 | 3.41 | 5.14 | 0.021 | 0.024 | 0.0095 | — | 26.0 | Satisfied | Present steel |
| U | 0.0053 | 0.90 | 0.050 | 0.015 | 0.0010 | 16.24 | 4.50 | 1.08 | 4.05 | 0.020 | 0.010 | 0.0031 | — | 47.4 | Satisfied | Present steel |
| V | 0.0322 | 0.05 | 0.910 | 0.014 | 0.0010 | 14.38 | 3.99 | 3.41 | 5.00 | 0.020 | 0.049 | 0.0027 | — | 13.5 | Satisfied | Present steel |
| W | 0.0113 | 0.22 | 0.273 | 0.016 | 0.0008 | 15.69 | 4.01 | 2.31 | 5.04 | 0.021 | 0.035 | 0.0032 | W:0.05 | 27.5 | Satisfied | Present steel |
| X | 0.0120 | 0.30 | 0.400 | 0.015 | 0.0010 | 14.66 | 4.23 | 1.36 | 5.40 | 0.019 | 0.023 | 0.0027 | W:0.80 | 23.4 | Satisfied | Present steel |
| Y | 0.0160 | 0.21 | 0.278 | 0.016 | 0.0010 | 15.13 | 4.19 | 2.83 | 4.89 | 0.020 | 0.025 | 0.0027 | Nb:0.102 | 25.9 | Satisfied | Present steel |
| Z | 0.0118 | 0.21 | 0.307 | 0.014 | 0.0010 | 16.10 | 4.00 | 2.00 | 5.37 | 0.022 | 0.018 | 0.0032 | V:0.06 | 28.9 | Satisfied | Present steel |
| AA | 0.0160 | 0.19 | 0.275 | 0.014 | 0.0010 | 14.65 | 4.54 | 3.40 | 4.60 | 0.020 | 0.028 | 0.0029 | B:0.004 | 26.4 | Satisfied | Present steel |
| AB | 0.0182 | 0.22 | 0.366 | 0.014 | 0.0011 | 15.66 | 4.33 | 2.95 | 4.78 | 0.019 | 0.039 | 0.0030 | Nb:0.421, V:0.38, B:0.005 | 28.7 | Satisfied | Present steel steel |
| AC | 0.0065 | 0.29 | 0.230 | 0.015 | 0.0010 | 16.28 | 4.09 | 2.11 | 4.03 | 0.021 | 0.008 | 0.0033 | Ti:0.07, Zr:0.06 | 40.3 | Satisfied | Present steel |
| AD | 0.0202 | 0.22 | 0.281 | 0.016 | 0.0010 | 15.34 | 3.99 | 3.50 | 5.41 | 0.019 | 0.019 | 0.0030 | Co:0.33, Ta:0.05 | 21.5 | Satisfied | Present steel |
| AE | 0.0102 | 0.36 | 0.318 | 0.012 | 0.0010 | 15.39 | 4.40 | 2.02 | 5.26 | 0.020 | 0.022 | 0.0029 | Ti:0.20, Zr:0.23 Co:0.78 Ta 0.07 | 29.3 | Satisfied | Present steel |
| AF | 0.0152 | 0.37 | 0.456 | 0.016 | 0.0010 | 16.20 | 4.33 | 2.97 | 5.31 | 0.018 | 0.038 | 0.0029 | Ca:0.0067, Mg:0.0045, Sn:0.13 | 29.7 | Satisfied | Present steel |
| AG | 0.0138 | 0.28 | 0.240 | 0.018 | 0.0011 | 14.84 | 4.07 | 1.97 | 5.44 | 0.018 | 0.026 | 0.0029 | REM:0.081 | 22.0 | Satisfied | Present steel |
| AH | 0.0190 | 0.40 | 0.333 | 0.014 | 0.0010 | 16.11 | 4.53 | 2.29 | 5.32 | 0.020 | 0.033 | 0.0030 | Sb:0.76 | 31.2 | Satisfied | Present steel |
| AI | 0.0103 | 0.32 | 0.290 | 0.015 | 0.0010 | 16.28 | 3.88 | 2.11 | 4.03 | 0.021 | 0.008 | 0.0033 | W:0.13, V:0.32 | 38.4 | Satisfied | Present steel |
| AJ | 0.0202 | 0.22 | 0.281 | 0016 | 0 0010 | 15.34 | 4.35 | 3.32 | 4.44 | 0.019 | 0.019 | 0.0022 | Nb:0.088, Ti:0.07 | 298 | Satisfied | Present steel |
| BG | 0.0189 | 0.21 | 0.275 | 0.016 | 0.0011 | 14.89 | 4.54 | 1.36 | 5.14 | 0.021 | 0.035 | 0.0027 | W:0.48, Ti:0.18, Ta:0.22 | 26.0 | Satisfied | Present steel |
| BH | 0.0173 | 0.20 | 0.302 | 0.014 | 0.0008 | 15.19 | 4.60 | 3.43 | 4.05 | 0.020 | 0.023 | 0.0030 | W:0.14, REM:0.192 | 32.9 | Satisfied | Present steel |
| BI | 0.0213 | 0.22 | 0.301 | 0.015 | 0.0010 | 15.55 | 4.35 | 3.41 | 5.00 | 0.020 | 0.025 | 0.0032 | W:0.55, Nb:0.313, B:0.007 | 27.0 | Satisfied | Present steel |
| BJ | 0.0224 | 0.22 | 0.280 | 0.014 | 0.0010 | 14.39 | 4.41 | 2.58 | 5.04 | 0.021 | 0.018 | 0.0030 | W:0.12, V:0.04, REM:0.212 | 22.2 | Satisfied | Present steel |
| BK | 0.0188 | 0.95 | 0.326 | 0.014 | 0.0012 | 14.52 | 4.31 | 2.53 | 5.40 | 0.019 | 0.028 | 0.0032 | W:0.71, Co:0.90, Mg:0.0071 | 24.0 | Satisfied | Present steel |
| BL | 0.0159 | 0.22 | 0.293 | 0.045 | 0.0010 | 14.91 | 4.23 | 2.95 | 4.53 | 0.019 | 0.039 | 0.0030 | W:0.63, Nb:0.097, Zr:0.12, Ca:0.0073 | 26.0 | Satisfied | Present steel |
| BM | 0.0127 | 0.20 | 0.278 | 0.015 | 0.0009 | 15.66 | 4.19 | 2.11 | 5.40 | 0.020 | 0.008 | 0.0032 | B:0.003, REM:0.087 | 28.1 | Satisfied | Present steel |
| BN | 0.0156 | 0.20 | 0.278 | 0.016 | 0.0009 | 15.37 | 4.00 | 3.50 | 5.41 | 0.018 | 0.038 | 0.0032 | V:0.12, Ti:0.18, Mg:0.0055 | 21.2 | Satisfied | Present steel |
| BO | 0.0199 | 0.20 | 0.307 | 0.016 | 0.0010 | 15.02 | 4.54 | 2.02 | 5.00 | 0.018 | 0.026 | 0.0028 | Co:1.11, Ca:0.0085 | 27.1 | Satisfied | Present steel |

(*1) The balance is Fe and incidental impurities (*3) Formula (1): $13.0 \leq -5.9 \times (7.82 + 27C - 0.91Si + 0.21Mn - 0.9Cr + Ni - 1.1Mo + 0.2Cu + 11N) = 50.0$ (*4) Value: $-5.9 \times (7.82 + 27C - 0.91Si + 0.21Mn - 0.9Cr + Ni - 1.1Mo + 0.2Cu + 11N)$

TABLE 1-2

| Steel No. | Composition (mass %) C | Si | Mn | P | S | Cr | Mo | Cu | Ni | Al | N | O | Other | Formula (1) (*3) Value (*4) | Evaluation | Remarks |
|---|---|---|---|---|---|---|---|---|---|---|---|---|---|---|---|---|
| AK | 0.0650 | 0.21 | 0.315 | 0.016 | 0.0010 | 15.75 | 4.14 | 2.76 | 5.46 | 0.022 | 0.018 | 0.0029 | — | 18.1 | Satisfied | Comparative steel |
| AL | 0.0137 | 1.05 | 0.303 | 0.015 | 0.0011 | 14.80 | 4.05 | 1.55 | 5.40 | 0.018 | 0.024 | 0.0029 | — | 26.6 | Satisfied | Comparative steel |
| AM | 0.0165 | 0.21 | 1.050 | 0.014 | 0.0011 | 16.22 | 4.46 | 3.23 | 4.61 | 0.020 | 0.016 | 0.0032 | — | 34.1 | Satisfied | Comparative steel |
| AN | 0.0081 | 0.20 | 0.004 | 0.016 | 0.0012 | 15.61 | 4.36 | 3.30 | 4.89 | 0.019 | 0.035 | 0.0031 | — | 29.9 | Satisfied | Comparative steel |
| AO | 0.0194 | 0.19 | 0.305 | 0.055 | 0.0010 | 15.89 | 4.30 | 2.70 | 5.05 | 0.020 | 0.028 | 0.0032 | — | 28.9 | Satisfied | Comparative steel |
| AP | 0.0157 | 0.21 | 0.299 | 0.014 | 0.0055 | 16.23 | 4.14 | 3.04 | 4.96 | 0.021 | 0.035 | 0.0029 | — | 30.1 | Satisfied | Comparative steel |
| AQ | 0.0153 | 0.20 | 0.308 | 0.014 | 0.0010 | 17.10 | 4.24 | 2.65 | 5.11 | 0.021 | 0.025 | 0.0032 | — | 35.6 | Satisfied | Comparative steel |
| AR | 0.0108 | 0.19 | 0.283 | 0.016 | 0.0011 | 13.90 | 4.34 | 3.31 | 5.49 | 0.022 | 0.033 | 0.0030 | — | 16.3 | Satisfied | Comparative steel |
| AS | 0.0168 | 0.20 | 0.294 | 0.015 | 0.0011 | 15.15 | 6.10 | 2.69 | 4.78 | 0.020 | 0.018 | 0.0029 | — | 39.4 | Satisfied | Comparative steel |
| AT | 0.0138 | 0.21 | 0.277 | 0.016 | 0.0009 | 15.75 | 3.70 | 2.56 | 4.76 | 0.019 | 0.034 | 0.0029 | — | 26.8 | Satisfied | Comparative steel |
| AU | 0.0190 | 0.20 | 0.276 | 0.016 | 0.0009 | 14.83 | 4.15 | 0.98 | 4.79 | 0.019 | 0.030 | 0.0029 | — | 25.9 | Satisfied | Comparative steel |
| AV | 0.0184 | 0.19 | 0.276 | 0.014 | 0.0009 | 15.92 | 4.14 | 2.70 | 6.10 | 0.022 | 0.015 | 0.0032 | — | 22.9 | Satisfied | Comparative steel |
| AW | 0.0162 | 0.22 | 0.319 | 0.015 | 0.0010 | 16.18 | 4.15 | 3.26 | 3.44 | 0.018 | 0.033 | 0.0032 | — | 38.6 | Satisfied | Comparative steel |
| AX | 0.0080 | 0.20 | 0.277 | 0.015 | 0.0009 | 16.20 | 4.32 | 1.59 | 5.01 | 0.105 | 0.018 | 0.0030 | — | 34.7 | Satisfied | Comparative steel |
| AY | 0.0104 | 0.20 | 0.278 | 0.016 | 0.0012 | 15.29 | 4.32 | 1.39 | 4.86 | 0.021 | 0.105 | 0.0027 | — | 25.0 | Satisfied | Comparative steel |
| AZ | 0.0109 | 0.21 | 0.307 | 0.014 | 0.0010 | 16.10 | 4.19 | 1.55 | 5.48 | 0.022 | 0.018 | 0.0105 | — | 30.2 | Satisfied | Comparative steel |
| BA | 0.0065 | 0.88 | 0.100 | 0.015 | 0.0010 | 16.28 | 5.50 | 1.23 | 4.03 | 0.021 | 0.008 | 0.0033 | — | 53.8 | Unsatisfied | Comparative steel |
| BB | 0.0535 | 0.06 | 0.900 | 0.014 | 0.0010 | 14.38 | 3.85 | 3.41 | 4.87 | 0.020 | 0.051 | 0.0022 | — | 9.8 | Unsatisfied | Comparative steel |
| BC | 0.0120 | 0.31 | 0.350 | 0.015 | 0.0010 | 14.66 | 4.23 | 1.36 | 5.40 | 0.019 | 0.023 | 0.0027 | W:1.00 | 23.5 | Satisfied | Comparative steel |
| BD | 0.0165 | 0.20 | 0.083 | 0.015 | 0.0009 | 16.11 | 4.23 | 1.25 | 5.51 | 0.033 | 0.017 | 0.0030 | Nb:0.563 | 30.1 | Satisfied | Comparative steel |
| BE | 0.0189 | 0.18 | 0.195 | 0.016 | 0.0010 | 15.77 | 4.00 | 1.33 | 3.78 | 0.041 | 0.009 | 0.0030 | V:0.58 | 36.8 | Satisfied | Comparative steel |
| BF | 0.0201 | 0.23 | 0.126 | 0.014 | 0.0010 | 16.28 | 3.90 | 3.34 | 4.48 | 0.028 | 0.025 | 0.0030 | B:0.0153 | 31.5 | Satisfied | Comparative steel |

(*1) The balance is Fe and incidental impurities (*2) Underline means outside of the range of the present invention (*3) Formula (1): $13.0 \leq -5.9 \times (7.82 + 27C - 0.91Si + 0.21Mn - 0.9Cr + Ni - 1.1Mo + 0.2Cu + 11N) = 50.0$ (*4) Value: $-5.9 \times (7.82 + 27C - 0.91Si + 0.21Mn - 0.9Cr + Ni - 1.1Mo + 0.2Cu + 11N)$ A test specimen was taken from the heat-treated test material (seamless steel pipe), and subjected to microstructure observation, a tensile test, an impact test, and a corrosion resistance test. The test methods are as follows.

(1) Microstructure Observation

A test specimen for microstructure observation was taken from the heat-treated test material in such an orientation that the observed cross section was along the pipe axis direction. The test specimen for microstructure observation was corroded with a Vilella's solution (a mixed reagent containing 2 g of picric acid, 10 ml of hydrochloric acid, and 100 ml of ethanol), and the structure was imaged with a scanning electron microscope (1,000 times magnification). The area percentage of the ferrite phase microstructure was then calculated with an image analyzer to find the volume fraction (volume %).

Separately, an X-ray diffraction test specimen was taken from the heat-treated test material. The test specimen was ground and polished to have a measurement cross section (C cross section) orthogonal to the axial direction of pipe, and the fraction of the retained austenite (y) phase microstructure was measured by an X-ray diffraction method. The fraction of the retained austenite phase microstructure was determined by measuring X-ray diffraction integral intensity for the (220) plane of the austenite phase (γ), and the (211) plane of the ferrite phase (α), and converting the calculated values using the following formula.

$$\gamma(\text{volume ratio})=100/(1+(I\alpha R\gamma/I\gamma R\alpha)),$$

wherein Iα is the integral intensity of α, Rα is the crystallographic theoretical value for α, Iγ is the integral intensity of γ, and Rγ is the crystallographic theoretical value for γ. The fraction of the martensitic phase is the remainder other than the fractions of the ferrite phase and retained y phase.

(2) Tensile Test

An API (American Petroleum Institute) arc-shaped tensile test specimen was taken from the heat-treated test material in such an orientation that the test specimen had a tensile direction along the pipe axis direction. The tensile test was conducted according to the API specifications to determine tensile properties (yield strength YS, tensile strength TS). The steel was determined as being a high-strength steel and acceptable when it had a yield strength, YS, of 862 MPa or more, and unacceptable when it had a yield strength YS of less than 862 MPa.

(3) Impact Test

A Charpy impact test was conducted in compliance with the JIS Z 2242 specifications using a V-notch test specimen (10 mm thick) taken from the heat-treated test material in such an orientation that the test specimen had a longitudinal direction along the pipe axis direction. The test was conducted in a temperature range of 50° C. to −120° C., and an absorption energy at −10° C., $VE_{-10}$, and a ductile-brittle transition temperature were determined for evaluation of low-temperature toughness. Each test was conducted for three test specimens, and the arithmetic mean of the measured values was calculated as the absorption energy (J) of the steel pipe.

The steel was determined as being acceptable when it had an absorption energy at −10° C., vE-10, of 300 J or more, and a ductile-brittle transition temperature of −40° C. or less, and unacceptable when it satisfied neither condition.

(4) Corrosion Resistance Test

A corrosion test specimen measuring 3 mm in thickness, 30 mm in width, and 40 mm in length was prepared from the heat-treated test material by machining, and subjected to a corrosion test to evaluate carbon dioxide corrosion resistance.

The corrosion test was conducted by dipping the corrosion test specimen in a test solution: a 20 mass % NaCl aqueous solution (liquid temperature: 200° C.; an atmosphere of 30-atm $CO_2$ gas) in an autoclave for 14 days (336 hours). The corrosion rate was determined from the calculated reduction in the weight of the tested specimen measured before and after the corrosion test. The steel was determined as being acceptable when it had a corrosion rate of 0.127 mm/y or less, and unacceptable when it had a corrosion rate of more than 0.127 mm/y.

A round rod-shaped test specimen (diameter: 6.4 mm) was prepared from the test specimen material by machining in compliance with NACE TM0177, Method A, and subjected to a sulfide stress cracking resistance test (SSC resistance test).

The SSC resistance test was conducted by dipping a test specimen in a test solution: a 20 mass % NaCl aqueous solution (liquid temperature: 25° C.; an atmosphere of 0.1-atm $H_2S$ and 0.9-atm $CO_2$) kept in an autoclave and having an adjusted pH of 3.0 with addition of acetic acid and sodium acetate, and applying a stress equal to 90% of the yield stress for 720 hours in the solution. The tested specimen was observed for the presence or absence of cracking. The steel was determined as being acceptable when it did not have a crack, and unacceptable when it had a crack.

A four-point bending test specimen measuring 3 mm in thickness, 15 mm in width, and 115 mm in length was taken from the test specimen material by machining, and subjected to a sulfide stress corrosion cracking resistance test (SCC resistance test) in compliance with EFC (European Federation of Corrosion) 17.

The SCC resistance test was conducted by dipping a test specimen in a test solution: a 20 mass % NaCl aqueous solution (liquid temperature: 100° C.; an atmosphere of 0.1-atm $H_2S$ and 30-atm $CO_2$) kept in an autoclave and having an adjusted pH of 3.3 with addition of acetic acid and sodium acetate, and applying a stress equal to 100% of the yield stress for 720 hours in the solution. The tested specimen was observed for the presence or absence of cracking. The steel was determined as being acceptable when it did not have a crack, and unacceptable when it had a crack.

The results are presented in Table 2.

TABLE 2-1

| Steel No. | Steel pipe No. | Microstructure (volume %) M (*1) | F (*1) | A (*1) | Yield strength YS (MPa) | Transition $vE_{50}$ (J) | Corrosion temp. (° C.) | rate (mm/y) | SSC | SCC | Remarks |
|---|---|---|---|---|---|---|---|---|---|---|---|
| A | 1 | 63 | 24 | 13 | 953 | 323 | −50 | 0.011 | Acceptable | Acceptable | Present Example |
| B | 2 | 70 | 20 | 10 | 960 | 311 | −45 | 0.012 | Acceptable | Acceptable | Present Example |
| C | 3 | 70 | 19 | 11 | 959 | 322 | −50 | 0.010 | Acceptable | Acceptable | Present Example |
| D | 4 | 63 | 14 | 23 | 902 | 329 | −55 | 0.065 | Acceptable | Acceptable | Present Example |
| E | 5 | 42 | 40 | 18 | 888 | 333 | −55 | 0.055 | Acceptable | Acceptable | Present Example |
| F | 6 | 66 | 19 | 15 | 977 | 307 | −45 | 0.019 | Acceptable | Acceptable | Present Example |
| G | 7 | 63 | 28 | 9 | 870 | 339 | −60 | 0.015 | Acceptable | Acceptable | Present Example |
| H | 8 | 60 | 30 | 10 | 940 | 316 | −45 | 0.055 | Acceptable | Acceptable | Present Example |
| I | 9 | 63 | 28 | 9 | 948 | 320 | −50 | 0.058 | Acceptable | Acceptable | Present Example |
| J | 10 | 45 | 40 | 15 | 888 | 319 | −50 | 0.006 | Acceptable | Acceptable | Present Example |
| K | 11 | 73 | 16 | 11 | 971 | 308 | −45 | 0.036 | Acceptable | Acceptable | Present Example |
| L | 12 | 45 | 40 | 15 | 887 | 309 | −45 | 0.008 | Acceptable | Acceptable | Present Example |
| M | 13 | 64 | 24 | 12 | 959 | 311 | −45 | 0.046 | Acceptable | Acceptable | Present Example |
| N | 14 | 62 | 23 | 15 | 921 | 317 | −50 | 0.010 | Acceptable | Acceptable | Present Example |
| O | 15 | 60 | 32 | 8 | 879 | 331 | −55 | 0.021 | Acceptable | Acceptable | Present Example |
| P | 16 | 51 | 24 | 25 | 876 | 350 | −65 | 0.019 | Acceptable | Acceptable | Present Example |
| Q | 17 | 52 | 37 | 11 | 869 | 353 | −65 | 0.071 | Acceptable | Acceptable | Present Example |
| R | 18 | 64 | 24 | 12 | 953 | 305 | −42 | 0.017 | Acceptable | Acceptable | Present Example |
| S | 19 | 58 | 15 | 27 | 873 | 310 | −45 | 0.015 | Acceptable | Acceptable | Present Example |
| T | 20 | 67 | 23 | 10 | 953 | 308 | −45 | 0.060 | Acceptable | Acceptable | Present Example |
| U | 21 | 49 | 49 | 2 | 866 | 309 | −45 | 0.017 | Acceptable | Acceptable | Present Example |
| V | 22 | 69 | 2 | 29 | 876 | 339 | −60 | 0.025 | Acceptable | Acceptable | Present Example |
| W | 23 | 63 | 22 | 15 | 893 | 311 | −45 | 0.022 | Acceptable | Acceptable | Present Example |
| X | 24 | 69 | 20 | 11 | 931 | 307 | −45 | 0.009 | Acceptable | Acceptable | Present Example |
| Y | 25 | 64 | 24 | 12 | 945 | 320 | −50 | 0.011 | Acceptable | Acceptable | Present Example |
| Z | 26 | 54 | 33 | 13 | 887 | 309 | −45 | 0.010 | Acceptable | Acceptable | Present Example |
| AA | 27 | 60 | 30 | 10 | 966 | 310 | −45 | 0.013 | Acceptable | Acceptable | Present Example |
| AB | 28 | 57 | 31 | 12 | 937 | 318 | −50 | 0.020 | Acceptable | Acceptable | Present Example |
| AC | 29 | 64 | 24 | 12 | 953 | 305 | −42 | 0.017 | Acceptable | Acceptable | Present Example |
| AD | 30 | 72 | 15 | 13 | 969 | 307 | −42 | 0.016 | Acceptable | Acceptable | Present Example |
| AE | 31 | 57 | 27 | 16 | 943 | 315 | −45 | 0.019 | Acceptable | Acceptable | Present Example |
| AF | 32 | 56 | 28 | 16 | 934 | 320 | −50 | 0.018 | Acceptable | Acceptable | Present Example |
| AG | 33 | 71 | 18 | 11 | 953 | 309 | −45 | 0.022 | Acceptable | Acceptable | Present Example |
| AH | 34 | 50 | 32 | 18 | 910 | 322 | −50 | 0.025 | Acceptable | Acceptable | Present Example |
| Al | 35 | 45 | 40 | 15 | 930 | 322 | −50 | 0.011 | Acceptable | Acceptable | Present Example |
| AJ | 36 | 64 | 24 | 12 | 957 | 309 | −45 | 0.010 | Acceptable | Acceptable | Present Example |
| BG | 59 | 51 | 34 | 15 | 943 | 320 | −50 | 0.011 | Acceptable | Acceptable | Present Example |
| BH | 60 | 64 | 28 | 8 | 969 | 311 | −45 | 0.010 | Acceptable | Acceptable | Present Example |
| BI | 61 | 54 | 36 | 10 | 944 | 309 | −42 | 0.013 | Acceptable | Acceptable | Present Example |
| BJ | 62 | 47 | 31 | 22 | 909 | 333 | −55 | 0.025 | Acceptable | Acceptable | Present Example |
| BK | 63 | 50 | 30 | 20 | 934 | 328 | −45 | 0.011 | Acceptable | Acceptable | Present Example |
| BL | 64 | 62 | 27 | 11 | 955 | 315 | −45 | 0.016 | Acceptable | Acceptable | Present Example |
| BM | 65 | 61 | 26 | 13 | 971 | 331 | −60 | 0.019 | Acceptable | Acceptable | Present Example |
| BN | 66 | 48 | 33 | 19 | 888 | 329 | −60 | 0.006 | Acceptable | Acceptable | Present Example |
| BO | 67 | 59 | 32 | 9 | 943 | 302 | −42 | 0.036 | Acceptable | Acceptable | Present Example |

(*1) M: Tempered martensitic phase, F: Ferrite phase, A: Retained austenite phase

TABLE 2-2

| Steel No. | Steel pipe No. | Microstructure (volume %) M (*1) | F (*1) | A (*1) | Yield strength YS (MPa) | $vE_{50}$ (J) | Transition temp. (° C.) | Corrosion rate (mm/Y) | SSC | SCC | Remarks |
|---|---|---|---|---|---|---|---|---|---|---|---|
| AK | 37 | 57 | 14 | 29 | 866 | 334 | −55 | 0.135 | Unacceptable | Unacceptable | Comparative Example |
| AL | 38 | 55 | 24 | 21 | 869 | 306 | −45 | 0.138 | Unacceptable | Unacceptable | Comparative Example |
| AM | 39 | 46 | 34 | 20 | 1002 | 289 | −35 | 0.019 | Acceptable | Acceptable | Comparative Example |
| AN | 40 | 67 | 27 | 6 | 848 | 345 | −60 | 0.016 | Acceptable | Acceptable | Comparative Example |
| AO | 41 | 63 | 26 | 11 | 956 | 309 | −45 | 0.137 | Unacceptable | Unacceptable | Comparative Example |
| AP | 42 | 62 | 28 | 10 | 945 | 322 | −50 | 0.140 | Unacceptable | Unacceptable | Comparative Example |
| AQ | 43 | 38 | 40 | 22 | 848 | 315 | −45 | 0.010 | Acceptable | Acceptable | Comparative Example |
| AR | 44 | 79 | 12 | 9 | 990 | 303 | −42 | 0.153 | Unacceptable | Unacceptable | Comparative Example |
| AS | 45 | 44 | 38 | 18 | 880 | 253 | −20 | 0.014 | Acceptable | Acceptable | Comparative Example |
| AT | 46 | 66 | 24 | 10 | 966 | 310 | −45 | 0.130 | Unacceptable | Unacceptable | Comparative Example |
| AU | 47 | 70 | 23 | 7 | 860 | 348 | −60 | 0.147 | Unacceptable | Unacceptable | Comparative Example |
| AV | 48 | 38 | 19 | 43 | 840 | 363 | −70 | 0.020 | Acceptable | Acceptable | Comparative Example |
| AW | 49 | 49 | 44 | 7 | 847 | 321 | −50 | 0.089 | Acceptable | Acceptable | Comparative Example |
| AX | 50 | 54 | 33 | 13 | 947 | 286 | −30 | 0.016 | Acceptable | Acceptable | Comparative Example |
| AY | 51 | 49 | 22 | 29 | 865 | 271 | −25 | 0.015 | Acceptable | Acceptable | Comparative Example |
| AZ | 52 | 58 | 31 | 11 | 944 | 276 | −30 | 0.131 | Unacceptable | Unacceptable | Comparative Example |
| BA | 53 | 32 | 61 | 7 | 807 | 315 | −45 | 0.018 | Acceptable | Acceptable | Comparative Example |
| BB | 54 | 62 | 5 | 33 | 860 | 350 | −65 | 0.031 | Acceptable | Acceptable | Comparative Example |
| BC | 55 | 67 | 20 | 13 | 918 | 269 | −25 | 0.008 | Acceptable | Acceptable | Comparative Example |
| BD | 56 | 58 | 32 | 10 | 989 | 69 | 0 | 0.022 | Unacceptable | Acceptable | Comparative Example |
| BE | 57 | 46 | 39 | 15 | 987 | 78 | 0 | 0.009 | Unacceptable | Acceptable | Comparative Example |
| BF | 58 | 53 | 34 | 13 | 932 | 91 | −10 | 0.011 | Acceptable | Acceptable | Comparative Example |

(*1) M: Tempered martensitic phase, F: Ferrite phase, A: Retained austenite phase
(*2) Underline means outside of the range of the present invention The stainless steel seamless pipes of the present examples all had high strength with a yield strength YS of 862 MPa or more, and high toughness with an absorption energy at −10° C. of 300 J or more, and a ductile-brittle transition temperature of −40° C. or less. The stainless steel seamless pipes of the present examples also had excellent corrosion resistance (carbon dioxide corrosion resistance) in a $CO_2$— and $Cl^-$-containing high-temperature corrosive environment of 200° C., and excellent sulfide stress cracking resistance and excellent sulfide stress corrosion cracking resistance as demonstrated by the absence of cracking (SSC and SCC) in a $H_2S$-containing environment.

The invention claimed is:

1. A stainless steel seamless pipe having a composition comprising, in mass %, C: 0.06% or less, Si: 1.0% or less, Mn: 0.01% or more and 1.0% or less, P: 0.05% or less, S: 0.005% or less, Cr: 14.0% or more and 17.0% or less, Mo: more than 3.80% and 6.0% or less, Cu: more than 1.03% and 3.5% or less, Ni: 3.5% or more and 6.0% or less, Al: 0.10% or less, N: 0.10% or less, O: 0.010% or less, and a balance being Fe and incidental impurities, wherein C, Si, Mn, Cr, Ni, Mo, Cu, and N satisfy the following Formula (1):

$$13.0 \leq -5.9 \times (7.82 + 27C - 0.91Si + 0.21Mn - 0.9Cr + Ni - 1.1Mo + 0.2Cu + 11N) \leq 50.0, \quad (1)$$

where C, Si, Mn, Cr, Ni, Mo, Cu, and N represent the content of each element in mass %, the stainless steel seamless pipe has a microstructure that contains at least 40% martensitic phase, at most 60% ferrite phase, and at most 30% retained austenite phase by volume, the stainless steel seamless pipe has a yield strength of 862 MPa or more, and the stainless steel seamless pipe exhibits an absorption energy at −10° C. in a Charpy impact test, $vE_{-10}$, of 300 J or more.

2. The stainless steel seamless pipe according to claim 1, wherein the composition further comprises, in mass %, at least one selected from the group consisting of group A, group B, group C, and group D:

group A:

W: 0.84% or less, group B: at least one selected from the group consisting of:

Nb: 0.5% or less,

V: 0.5% or less, and

B: 0.01% or less, group C: at least one selected from the group consisting of:

Ti: 0.3% or less,

Zr: 0.3% or less,

Co: 1.5% or less, and

Ta: 0.3% or less, and group D: at least one selected from the group consisting of:

Ca: 0.01% or less,

REM: 0.3% or less,

Mg: 0.01% or less,

Sn: 0.2% or less, and

Sb: 1.0% or less.

3. The stainless steel seamless pipe according to claim 1, wherein the composition further comprises, in mass %, W: 0.80% or less.

4. The stainless steel seamless pipe according to claim 1, wherein the composition further comprises, in mass %, W: 0.05% or less.

5. The stainless steel seamless pipe according to claim 1, wherein the Cu is present, in mass %, in an amount of 1.08% or more and 3.5% or less.

6. The stainless steel seamless pipe according to claim 1, wherein the amount of ferrite phase is 28% or less.

7. The stainless steel seamless pipe according to claim 1, wherein the stainless steel seamless pipe exhibits a ductile-brittle transition temperature of −40° C. or less.

8. The stainless steel seamless pipe according to claim 1, wherein the stainless steel seamless pipe exhibits the absorption energy at −10° C. in the Charpy impact test, $vE_{-10}$, that is in a range of from 300 J to 353 J.

* * * * *